US012383060B2

(12) United States Patent
Chen

(10) Patent No.: US 12,383,060 B2
(45) Date of Patent: Aug. 12, 2025

(54) DEVICE FOR SELF-BOUNCING AND SLOWLY CLOSING DRAWER

(71) Applicant: BAI FU CO., LTD., Taipei (TW)

(72) Inventor: Huang-Chi Chen, Taipei (TW)

(73) Assignee: BAI FU CO., LTD., Taipei (TW)

( * ) Notice: Subject to any disclaimer, the term of this patent is extended or adjusted under 35 U.S.C. 154(b) by 112 days.

(21) Appl. No.: 18/516,959

(22) Filed: Nov. 22, 2023

(65) Prior Publication Data

US 2025/0160516 A1 May 22, 2025

(30) Foreign Application Priority Data

Jun. 29, 2023 (TW) ..... 112206647

(51) Int. Cl.
*A47B 88/467* (2017.01)
*A47B 88/477* (2017.01)

(52) U.S. Cl.
CPC ..... *A47B 88/467* (2017.01); *A47B 88/477* (2017.01)

(58) Field of Classification Search
CPC ..... A47B 88/467; A47B 88/477
See application file for complete search history.

(56) References Cited

U.S. PATENT DOCUMENTS 7,815,267 B1 * 10/2010 Frousiakis ..... A47B 88/467 312/319.1
2019/0239644 A1 * 8/2019 Pohlmann ..... A47B 88/467
2020/0337456 A1 * 10/2020 Chen ..... A47B 88/477

* cited by examiner

*Primary Examiner* — Amy J. Sterling
(74) *Attorney, Agent, or Firm* — Leong C. Lei

(57) ABSTRACT

A device for auto-bouncing and slowly closing a drawer mainly provides a buffer device on a slide rail between a drawer and a left side opposite surface or right side opposite surface of a drawer slot, so that the impact is reduced and the drawer is automatically pulled back when the drawer is closed. At the same time, a door bouncing device is operated in coordination with, so that the drawer can be automatically eject to a specific position when the drawer is pressed, so as to achieve the multiple practicality.

5 Claims, 6 Drawing Sheets

DEVICE FOR SELF-BOUNCING AND SLOWLY CLOSING DRAWER

BACKGROUND OF THE INVENTION

(a) Technical Field of the Invention

The present invention relates to a device for self-bouncing and slowly closing a drawer that can easily control the automatic opening and closing of the drawers of cabinets of furniture or various storage devices.

(b) Description of the Prior Art

The drawer is a common and indispensable storage device in public life. It is mainly installed in the cabinet of general furniture or various storage equipment. The opening or closing action of the drawer can be manually controlled through the slide rail device so as to take or place items from or in the drawer. The common slide rails are set on both sides of the drawer, and the drawer is limited by the guidance of the slide rails and manual operation, so as to control the opening and closing of the drawer. However, since most of the slide rails only have the guide function of reducing the friction resistance of the drawer opening and closing and limiting slippage, so that the user is very likely to cause damage or a lot of noise due to the uncontrollable force applied during operation. To increase the use convenience of a drawer, the manufacturers only increase the efficiency of the slide rails to reduce slip, but there are only automatic slow-push mechanisms in the market, which makes the drawer open slowly to prevent slippage or noise caused by over-opening, not only inconvenient in operation but limited in practical values.

SUMMARY OF THE INVENTION

The present invention mainly provides a buffer device on a slide rail between a drawer and the left or right side opposite surface of a drawer slot, so that the impact is reduced and the drawer is automatically pulled back when the drawer is closed. At the same time, a door bouncing device is operated in coordination with, so that the drawer can be automatically eject to a specific position when the drawer is touch, so as to achieve the multiple practicality.

DETAILED DESCRIPTION OF THE PREFERRED EMBODIMENTS

Figure 1:
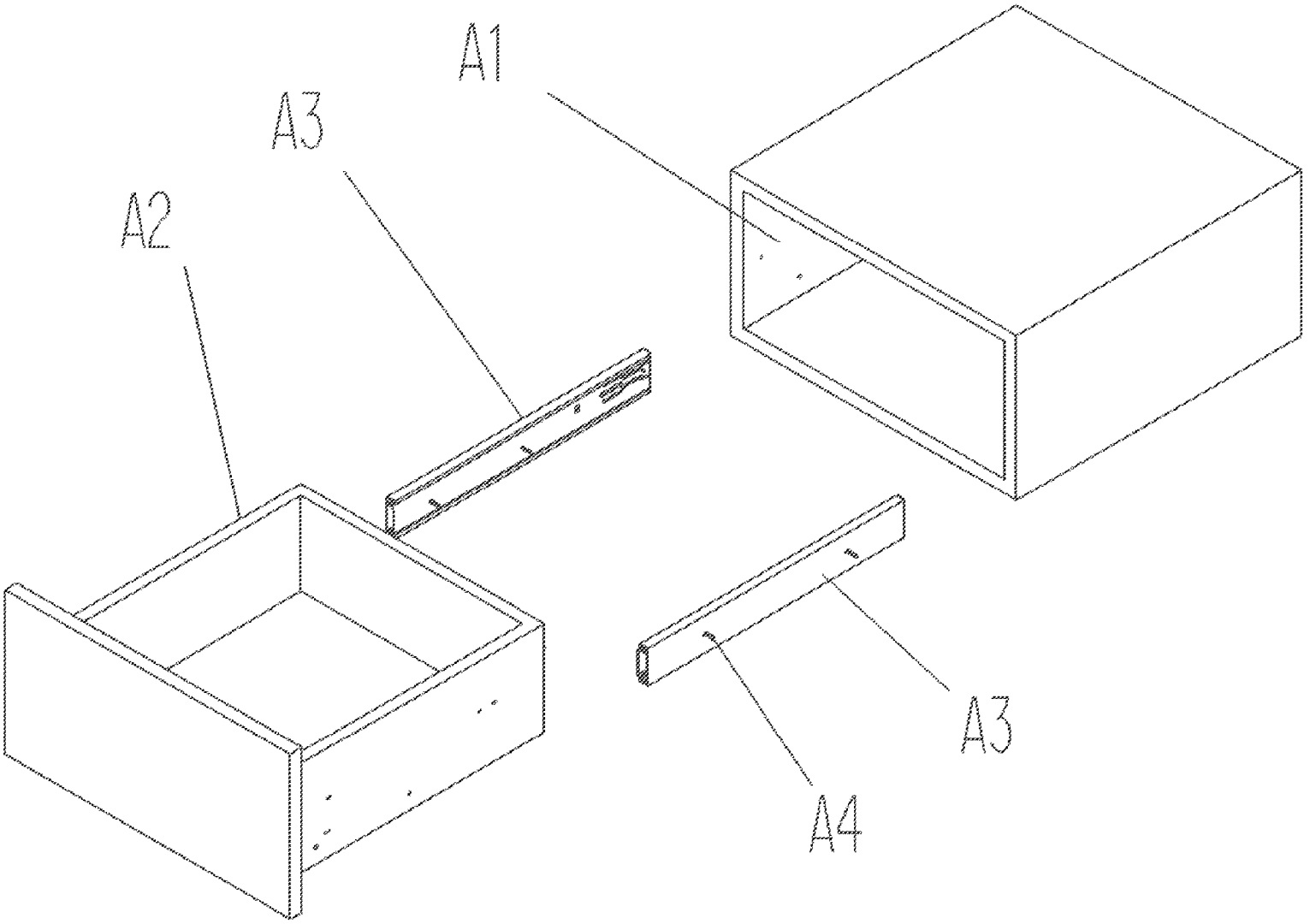
FIG. 1 PRIOR ART
FIG. 1 is a perspective view of a conventional art.

As shown in FIG. 1, which is a perspective view of a conventional structure, a slide rail A3 is respectively locked and provided between a drawer slot A1 and the right and left side opposite surfaces of a drawer A2 through a fixing rod A4, so that the drawer A2 can be opened or closed from or in the drawer slot A1 of the cabinet by pushing or pulling it, so as to take or store an item from or in the drawer A2. The above conventional structure mostly only has the functions of reducing friction resistance when the drawer A2 is opened or closed or the guidance to limit slippage, such that the damage is caused or a great amount of noise is generated to affect the tranquility of the environment if improper fore is exerted upon operation, the operation being inconvenient and the practical values being expected to improve.

FIGS. 2 to 6 of the present invention are diagrams of an embodiment in which the device for automatic-bouncing and slowly closing a drawer of the present invention is disposed on the slide rail between the right side opposite surface of the drawer A2 and the drawer slot A1 for ease of explanation. If it is disposed on the other side, then the direction sequence of the composition is reversed.

Figure 2:
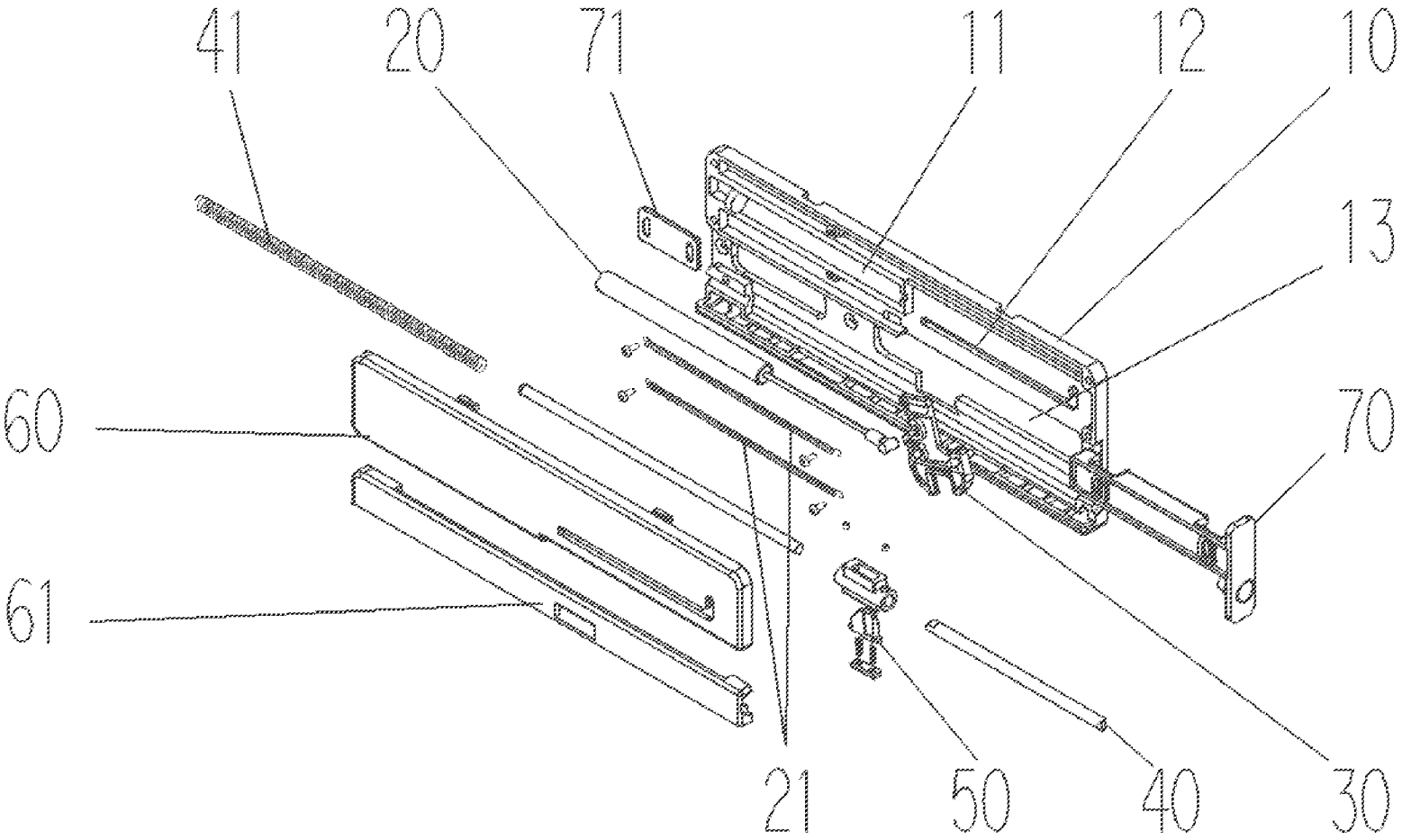
FIG. 2 is an exploded view of the present invention.
Figure 3:
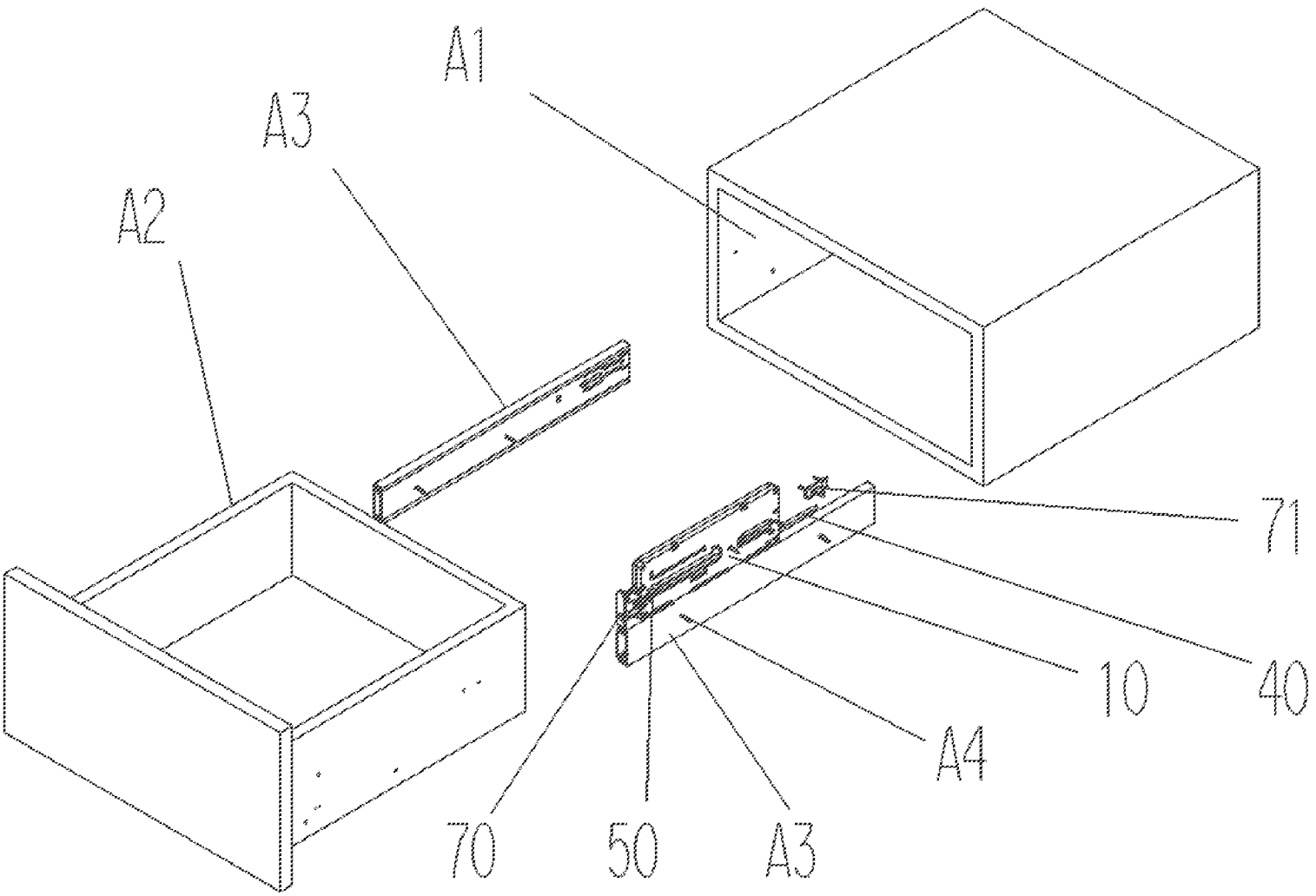
FIG. 3 is a perspective view of the entire implementation of the present invention.
Figure 4:
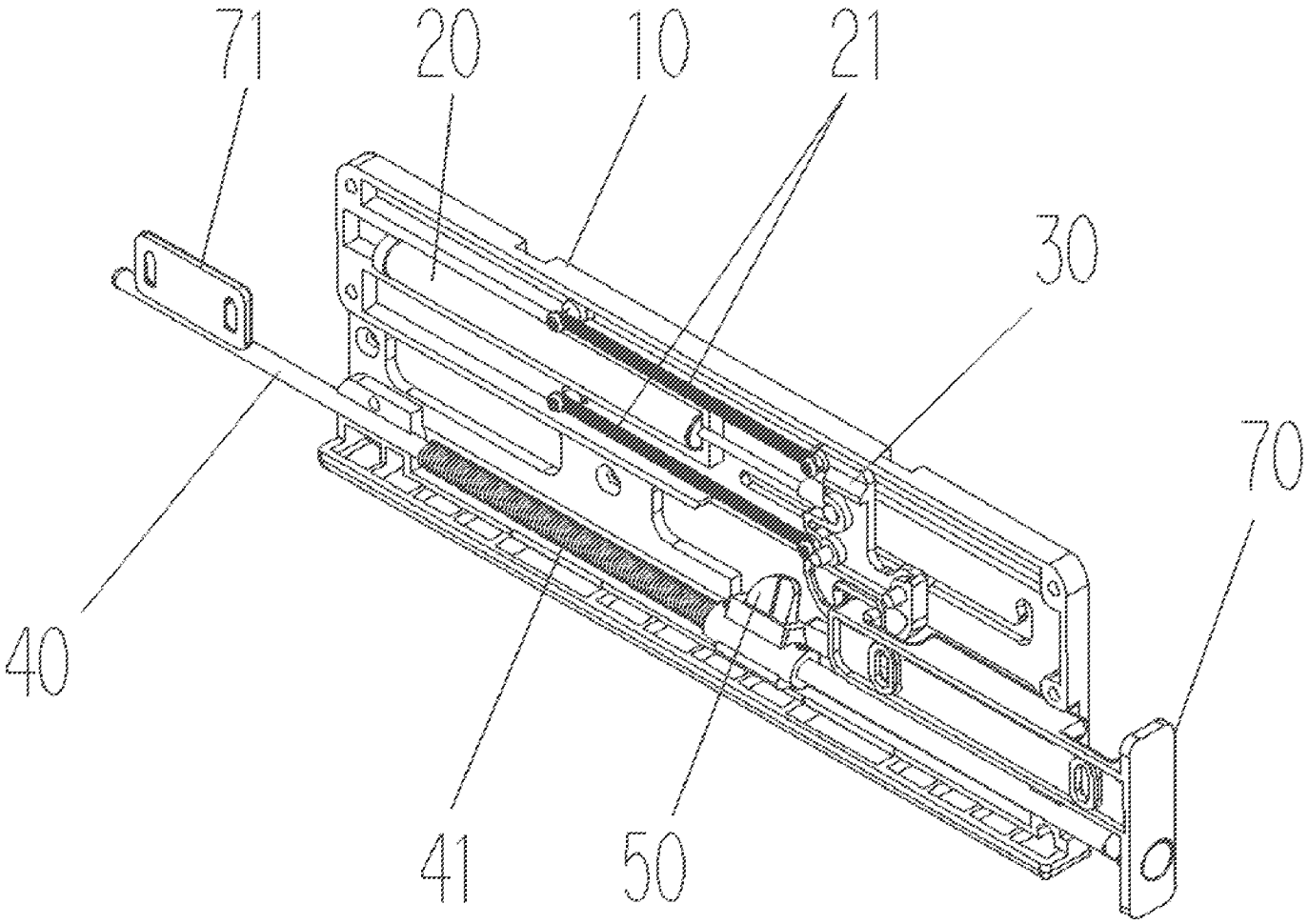
FIG. 4 is a perspective view of the closing implementation of the present invention.
Figure 5:
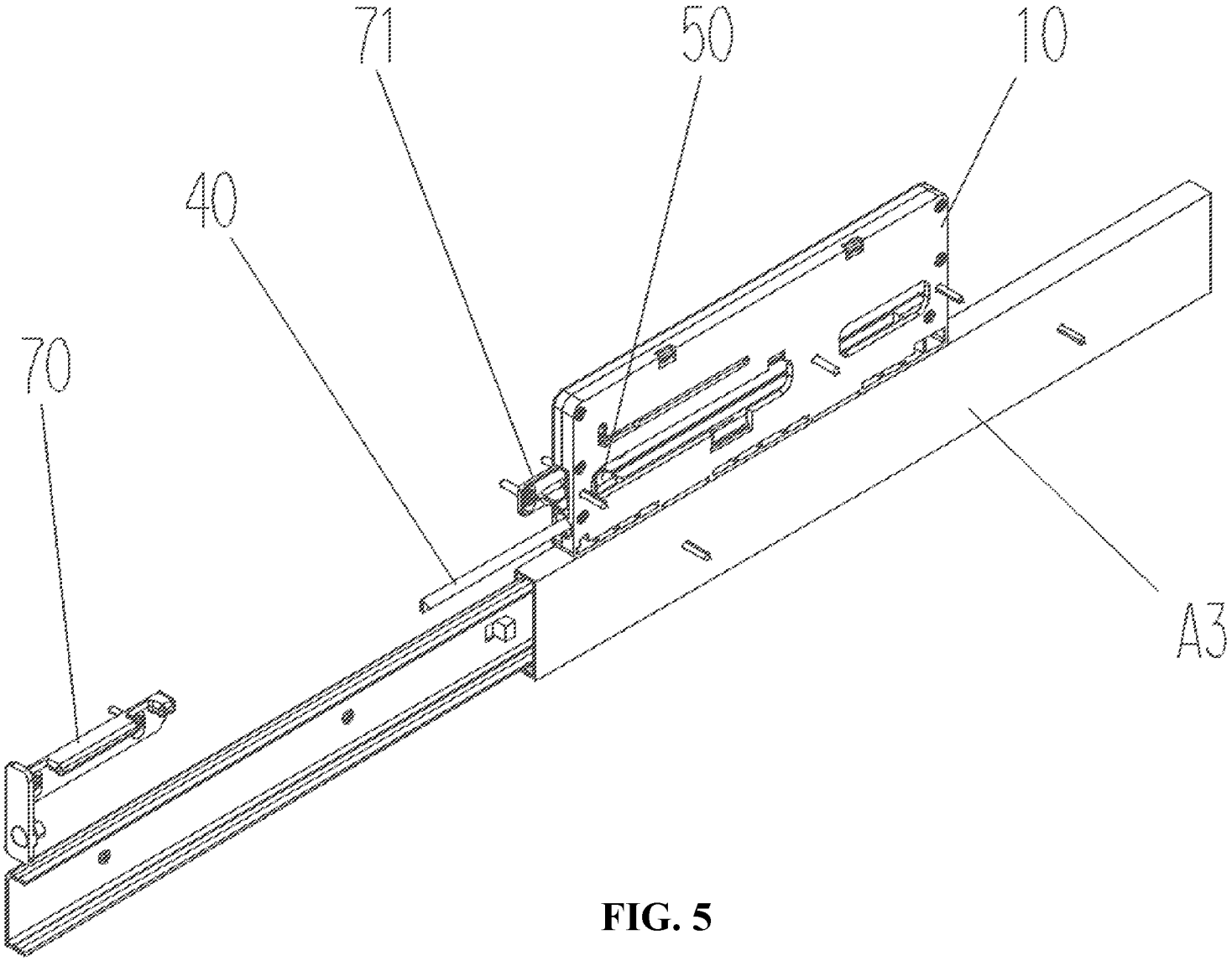
FIG. 5 is a perspective view of the opening implementation of the present invention.
Figure 6:
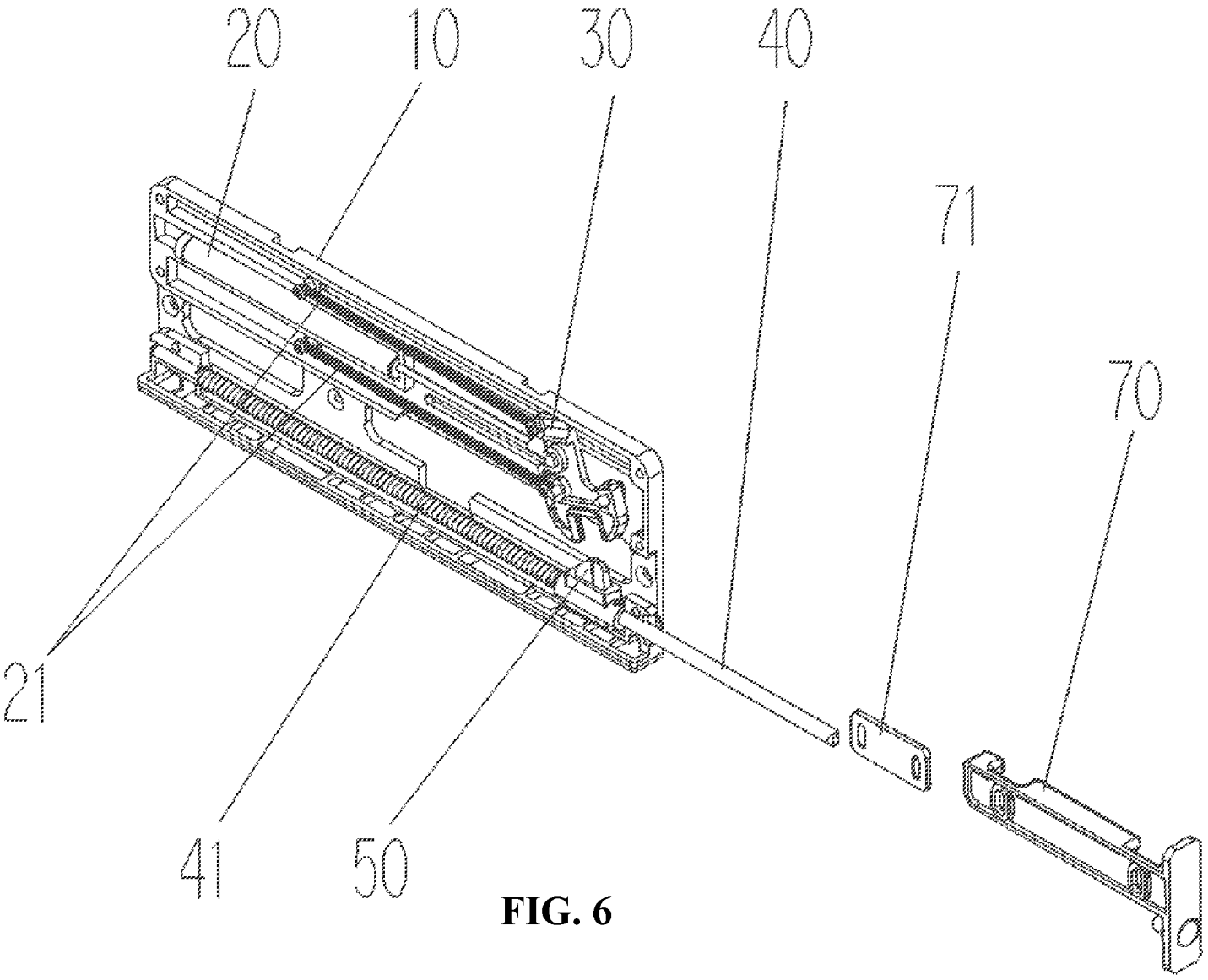
FIG. 6 is a partly perspective view of the opening implementation of the present invention.

Referring to FIG. 2, where a preferred embodiment of the present invention is shown, the device for automatic-bouncing and slowly closing a drawer of the present invention is constituted as the following: a seat body 10 is provided with a buffer groove 11, buffer hook groove 12 and door bouncing groove 13, where the buffer groove 11 of the seat body 10 is provided with a buffer rod 20 provided with a plurality of pull springs 21, the buffer hook groove 12 of the seat body 10 a buffer hook 30 operated in coordination with the buffer rod 20 and pull springs 21, and the door bouncing groove 13 of the seat body 10 a door bouncing rod 40. Furthermore, the door bouncing rod 40 is provided with a compression spring 41 and a door bouncing hook 50 operated in coordination therewith, and the outer end of the seat 10 is respectively covered with a upper cover 60 and lower cover 61; the outer end of the seat body 10 is respectively provided with a push seat 70 and fixing block 71. Whereby, a self-bouncing and slowly-closing device with a simple, practical drawer operating manner can be obtained by the control of allowing the buffer rod 20 and door bouncing rod 40 to be operated in coordination with the buffer hook 30 and door bouncing hook 50.

Referring to FIGS. 3 to 6, the seat body 10 of the present invention is fixed on the slide rail A3 locked by the fixing rod A4 between the drawer slot A1 of the cabinet and the opposite surface of one side of the drawer A2. Therefore, the push seat 70, fixing block 71 can control the door bouncing rod 40, door bouncing hook 50 by pressing the drawer A2, and the functions of the pull springs 21 and compression spring 41 are cooperated with to easily control the automatic slow opening or closing of the drawer A2.

When the opened drawer A2 is to be closed in the drawer slot A1 of the cabinet, it only needs to be lightly pressed and pushed into the drawer A2, and the fixing block 71 fixed on the drawer slot A1 and drawer A2 will then touch and move the door bouncing hook 50 inside the seat body 10, so that the door bouncing rod 40 and door bouncing hook 50 can be pulled by the pull springs 21 to a specific position, and the door bouncing hook 50 is allowed to be turned and fixed on the specific position. Furthermore, the drawer A2 is allowed to be closed continuously due to inertia, and the action of the closing of the drawer A2 is stopped due to buffer when the push seat 70 touches the buffer gook 30. Furthermore, the pull springs 21 is cooperated to allow the buffer hook 30 to be hooked on the push seat 70, thereby allowing the drawer A2 to be easily, automatically closed inside the cabinet A1.

During the closing of the drawer A2 into the drawer slot A1 of the cabinet, the buffer rod 20 provided inside the seat body 10 can then slow down the speed of the drawer A2 when returned, and prevent the damage and noise thereof due to impact when closed.

When the drawer A2 closed inside the drawer slot A1 of the cabinet is to be opened, it is lightly pressed, and the push seat 70 of the seat body 10 pulls the buffer hook 30, allowing the door bouncing rod 40 and door bouncing hook 50 to be released, and the slide rails A3 to eject the drawer A2 with the action of the compression spring 41, thereby completing the automatic opening of the drawer A2.

To sum up, the above-mentioned elements of the present invention can be configured with any components for various combinations, so as to achieve the purpose of simple filling and packaging.

I claim:

1. A device for self-bouncing and slowly closing a drawer, providing a buffer groove, buffer hook groove and door bouncing groove on a seat body, a buffer rod provided on said buffer groove of said seat body, a plurality of pull springs said buffer rod, a compression spring said buffer hook groove of said seat body operated in coordination with said buffer rod and pull springs, a door bouncing rod said door bouncing groove of said seat body, a compression spring on said door bouncing rod and a door bouncing hook matched thereon, a upper cover and lower cover respectively covered on an outer end of said seat body, a push seat and fixing block respectively provided on said outer end of said seat body, and a simple operation of drawer self-bouncing and slow-closing can be achieved by cooperating said buffer rod and door bouncing rod with the control of said buffer hook and door bouncing hook, so that said cabinet drawer can be simply operated in automatic-bouncing and slow-closing.

2. The device according to claim 1, wherein said seat body is provided on a slide rail between said drawer of said cabinet and a left side opposite surface of right side opposite surface of a drawer slot, and a push seat, fixing block are respectively fixed on said slide rail, allowing said push seat, fixing block to control said door bouncing rod, door bouncing hook by pressing said drawer of said cabinet, and allowing the automatic slow opening or closing of said drawer to be easily controlled cooperating with the functions of said pull springs and compression spring.

3. The device according to claim 1, wherein said buffer hook inside said seat body configured on said slide rail between said drawer of said cabinet and a left side opposite surface or right side opposite surface of a drawer slot allows a fixing block of said door bouncing hook to push said door bouncing hook, and said door hook is pulled by said pull spring to fix at a specific position, and said drawer is pulled to return to the inside of said cabinet cooperating with said slide rail, so that a simple, easy drawer closing can be achieved by pushing said drawer in.

4. The device according to claim 1, wherein said buffer rod provided inside said seat body slows returned speed of said drawer during said drawer is being closed, and prevents damage and noise caused by impact upon closing.

5. The device according to claim 1, wherein said push seat can act on said buffer hook, allowing said door bouncing rod and door bouncing hook to be released, and said slide rails to eject said drawer cooperating with the function of said compression spring, thereby completing the automatic opening of said drawer.

* * * * *